United States Patent [19]

Nolan et al.

[11] 4,093,277

[45] June 6, 1978

[54] ASSEMBLY FOR PREPARING INSERTS FOR HOSPITAL IDENTIFICATION BRACELETS

[75] Inventors: John L. Nolan, Glenview; Harvey M. Nordby, Buffalo Grove; Marvin E. Jensen, Niles, all of Ill.

[73] Assignee: Hollister Incorporated, Chicago, Ill.

[21] Appl. No.: 761,423

[22] Filed: Jan. 21, 1977

[51] Int. Cl.[2] ..... B41L 1/22; B41L 1/26

[52] U.S. Cl. ..... 282/24 R; 282/1 R; 282/19 R; 282/11.5 R; 40/21 C

[58] Field of Search ..... 282/24 R, 22 R, 23 R, 282/11.5 R, 11.5 A, 12 R, 12 A, 19 R, 26, 27 R, 1 R; 40/21 C

[56] References Cited

U.S. PATENT DOCUMENTS

| | | | |
|---|---|---|---|
| 2,020,287 | 11/1935 | Bonn | 282/24 R X |
| 2,557,875 | 6/1951 | Kerr | 282/22 R |
| 2,605,120 | 7/1952 | Brenn | 282/11.5 R |
| 2,907,585 | 10/1954 | Sornberger et al. | 282/12 A X |
| 2,954,620 | 10/1960 | Schneider | 40/21 C |
| 3,135,533 | 6/1964 | Short | 282/19 R |
| 4,029,341 | 6/1977 | Neill et al. | 282/22 R |

*Primary Examiner*—Jerome Schnall

*Attorney, Agent, or Firm*—Tilton, Fallon, Lungmus & Chestnut

[57] ABSTRACT

An assembly for preparing imprinted inserts for hospital identification bracelets includes severable base strips of card stock divided into an identification section and a handle section, and overlaying carbon strips which are retained in position during separation of the strips and imprinting, while being readily removable after the patient information has been imprinted on the identification section by a roller or platten.

1 Claim, 6 Drawing Figures

ASSEMBLY FOR PREPARING INSERTS FOR HOSPITAL IDENTIFICATION BRACELETS

BACKGROUND AND PRIOR ART

Hospital identification bracelets of the kind shown in U.S. Pat. No. 3,027,665 are in widespread use in the United States. These bracelets include a flat tubular strap member of transparent plastic into which is inserted an identification card that bears patient information. After insertion of the identification card, the ends of the strap are secured about the wrist of the patient by means of a clamp, which once locked cannot be readily removed. The cards used for the patient information are provided in the form of a sheet with parallel rows of perforations defining the individual cards or strips, and a transverse line of perforations defining the identification and handle sections of the cards. In hospital use, patient information may be entered longhand on an individual strip, or the sheet may be inserted in a typewriter for typing the individual strips. Another alternative, which has been practiced to some extent, is to insert the strips in a roller-type imprinter, the strip being superimposed on an embossed card bearing the patient information. When the roller is drawn over the strip, the roller, which contains ink, is pressed downwardly against the strip, and a printed impression of the patient information is formed. Such ink roller imprinters are supplied by a number of companies, such as Pitney Bowes and Addressograph. (Pitney Bowes, Inc., Stamford, Conn., and Addressograph Multigraph Corp., Cleveland, Ohio.)

Special non-smearing pens may be used for the longhand entry of information, and typewriters may be equipped with ribbons where the ink is relatively non-smearing. However, the inks used with roller imprinters, are subject to smearing or blurring, being essentially non-drying inks. As will be appreciated, illegibility of entered information can be a serious problem in hospital use. When a hospital is equipped with ink roller imprinters, it would be desirable to use these machines for printing the hospital bracelet identification cards, but the tendency of the entered information to become illegible has tended to limit this procedure. Longhand entry or typed entry has therefore been used although roller imprinting was available. There has been a recognized need for an improved kind of insert for hospital identification bracelets which could be used with ink roller imprinters while avoiding the problem of smearing and illegibility.

SUMMARY OF INVENTION

In connection with the development of the present invention, it was recognized that the usual manifold carbon paper form as used for roller imprinting with credit cards would not be suitable for hospital identification bracelet inserts. These forms are packets of interleaved sheets folded or bound on one side. To prepare such a form as a thin elongated strip would provide mechanical problems in manufacture, and such forms would be subject to disadvantages in use. With roller-type imprinters, the roller can be drawn across the form in either direction. It was therefore recognized to be important that any carbon paper associated with the form should be securely held down on both sides of the form. Further, the attachment of the carbon paper to the form had to be such that the individual strips could be separated from a larger sheet or assembly without disturbing the position and alignment of the carbon paper. At the same time, however, after the imprinting, the carbon paper had to be readily removable, and had to be arranged so that the attachment of the carbon paper did not interfere with or limit the application of the patient information. The present invention for the first time provides an answer to these problems. The hospital identification bracelet inserts of this invention can be imprinted with ink roller imprinters while obtaining a legible and non-smearing impression. The carbon paper is attached securely on both sides of the identification section of the patient strip, and therefore the ink roller can pass over the strip in either direction without disturbing the carbon paper. Further, the impression is made from the carbon coated side of the paper onto the identification section of the insert strip, permitting the use of carbon paper forming relatively non-smearing impressions. The ink from the roller is applied to the upper surface of the carbon so that it does not contact the identification section of the card, and on removal of the carbon, the ink coating is removed with it and discarded. With this construction, the bracelet inserts can also be imprinted with conventional imprinters for carbon forms, which utilize non-ink bearing rollers or plattens to press the form against the embossed credit card. In any case, once the patient identification information has been imprinted, the carbon strip is readily removable from either end, a pull-tab arrangement being provided on both ends of the carbon paper strip.

Other constructional features and advantages will be set forth in the following detailed specification.

THE DRAWINGS

In the accompanied drawings, FIG. 1 is a top plan view of an assembly for preparing roller imprinted inserts for hospital identification bracelets, representing a preferred embodiment of the present invention;

DETAILED SPECIFICATION

Figure 1:
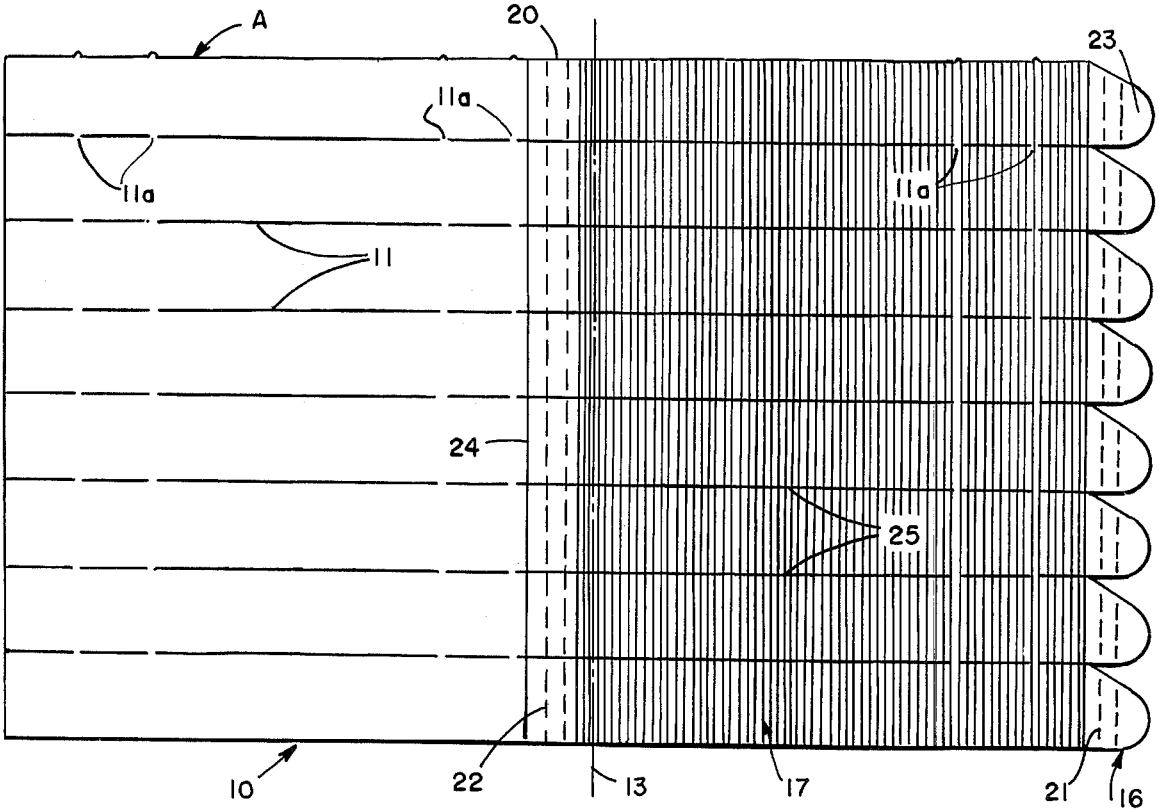

Looking first at FIG. 1, there is shown an assembly designated generally by the letter A, which is constructed in accordance with the present invention, for use in preparing roller imprinted inserts for hospital identification bracelets. The assembly includes a base sheet 10 of imprintable card stock, such as heavy white paper stock. Sheet 10 is divided by rows of parallel perforation slits 11 into a plurality of severable elongated base strips 12. The perforations may be in the form of long slits, as shown, the base strips 11 being connected by spaced ties (uncut portions of the base sheet) as indicated at 11*a*. In the illustration given, six ties per row are shown, but it will be apparent that the number of ties and the length of the slits between the ties can be varied.

Figure 2:
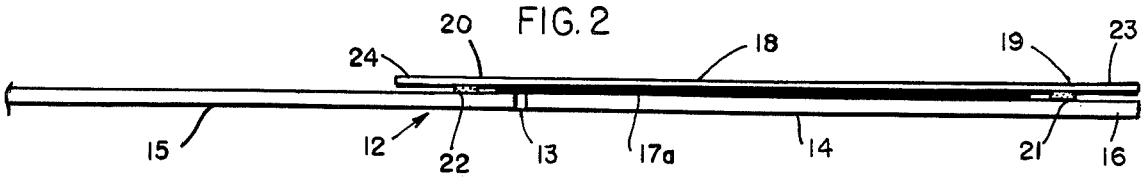
FIG. 2 is an enlarged fragmentary side elevational view of the insert assembly of FIG. 1, a portion of the handle section of the base strip being omitted.
Figure 6:
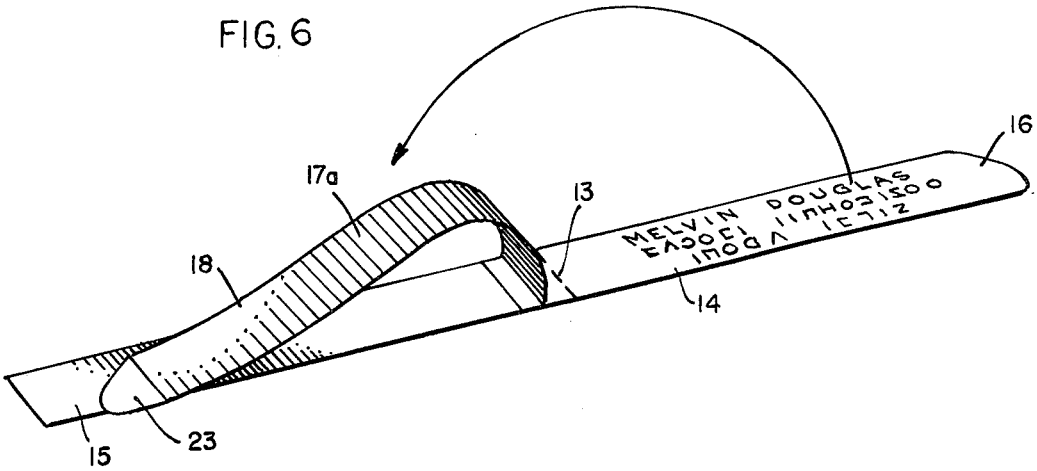
FIG. 6 is a perspective view illustrating the appearance of the carbon strip after it has been pulled back from the identification section of the base strip.

As shown in FIGS. 1, 2 and 6, the base strips 12 are divided by a transverse line of perforations 13 across the central portion thereof into an identification section 14 and a handle section 15. Small closely spaced perforations or slits may be employed for this purpose. The purpose is to permit handle section 15 to be separated from identification section 14 after the identification section has been inserted in the hospital bracelet. This construction is not new per se, and has been conventionally employed in connection with prior art hospital identification bracelets, such as the bracelet illustrated in U.S. Pat. No. 3,027,665. To assist the insertion, the outer ends of the identification sections 14 may be tapered, such as by rounding, as illustrated in FIG. 1, the outer insertion end portion indicated by number 16. The tapered shape of the insert end 16, which is preferably a rounded shape, in effect, provides notches between the base strips 12 which lead into the perforation lines 11, as shown more clearly in FIG. 1.

In accordance with the present invention, there is provided a sheet of carbon paper 17 arranged to overlay the identification sections 14 with the carbon-coated side against the surface of the identification sections. In FIG. 2, the carbon coating is indicated at 17*a*. As shown in FIG. 1, the carbon sheet 17 is divided into strips 18 by perforation or severance lines 25, which may correspond with the perforation slits 11 of the base sheet, with corresponding ties. Where a separate die cutting operation is used for forming severance lines 25, the ties in carbon sheet 17 can be omitted. Carbon sheet 17 is provided with uncoated margin portions on each side, so that there are uncoated portions of the carbon sheet at each end of the carbon strips 18. In the illustration given, the first uncoated margin 19 extends onto and over the insertion end portions 16. A second uncoated margin 20 is provided on the opposite side adjacent the line of division 13 between the identification handle sections. The margins 19 and 20 are adhesively attached to base sheet 10 in defined areas spaced inwardly from the outer edge of their respective margin. As shown in FIGS. 1 and 2, the adhesive coated areas are indicated at 21 and 22. The adhesive is applied in narrow bands extending transversely between the base sheet and the margins.

Also, for the purpose of the present invention, the margins 19, 20 are arranged to provide unattached tab portions extending outwardly from the adhesive areas. In the illustration given, the tabs 23 extend outwardly from the adhesive area 21 over the insertion ends 16, and the tabs 24 extend outwardly from the adhesive area 22 over the handle section 15. The function and purpose of the thus-located adhesive areas and tabs will be described below in the description of the operation of the inserts. It will be apparent, however, from the description already set forth that the base sheet strips 12 can be removed one at a time from the assembly A with a carbon strip 18 attached thereto.

The preferred arrangement of the carbon coating 17*a*, the line of perforations 13, the adhesive areas 21, 22, and the tabs, 23, and 24 are illustrated more clearly in FIG. 2. In this preferred embodiment, as shown, the margin 19 is adhesively attached to the insertion end portion 16, and the unattached tab portions 23 overlie the outer parts of the insertion end portions. As can be seen in FIG. 1, the margin 19 is cut so that it conforms with the rounded shape of the insertion end 16.

With reference again to FIG. 2, it can be seen that in this preferred embodiment, the second margin 20 extends over the portions of the handle sections 15 adjacent the line of division 13, and the margin 20 is adhesively attached to the handle section portions. Preferably, the coated portion of the carbon sheet as indicated at 17*a* in FIG. 2, extends over the line of division 13 onto the ends of the handle sections 13, while terminating short of the adhesive attachment area 22. However, where the identification section 14 is a sufficient length, the carbon coating 17*a* may terminate at or inwardly of the line of perforations 13. By having the adhesive area 22 outwardly of the line of perforations 13 and not in contact therewith, the adhesive is prevented from interfering with the separation of the handle sections from the identification section, as might occur if adhesive is applied to the perforations 13.

Various adhesives can be employed for the purpose of attaching the carbon sheets 17 to the base sheets 10. Preferably, a drying rather than a pressure-sensitive adhesive is selected, and a sufficient amount of the adhesive is applied to form a secure bond at each end of the carbon strips 18, while permitting ready removal of the carbon strips by means of the tabs 23 and 24. Preferably, the adhesive stays with the carbon strips on removal, leaving the surface of the base strip 12 as clean and free of adhesive as possible. The particular adhesive is not critical, and a wide variety of commercially available adhesives can be employed, such as those which have been used previously for uniting sheets of carbon paper to paper or paperboard.

OPERATION

Figure 4:
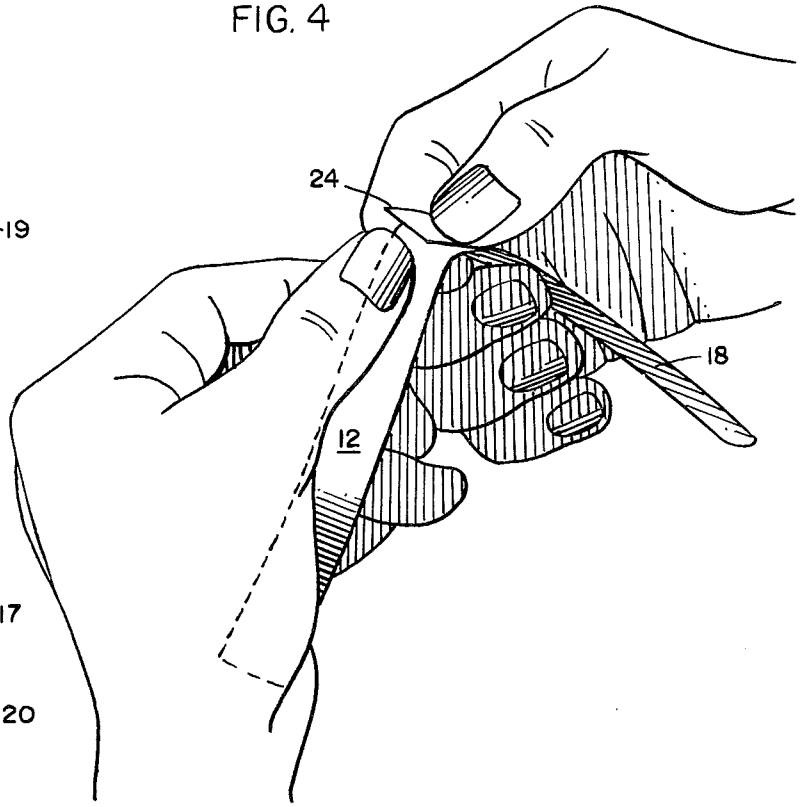
FIG. 4 is a perspective view illustrating one procedure for removing the carbon strip after imprinting the base strip.
Figure 3:
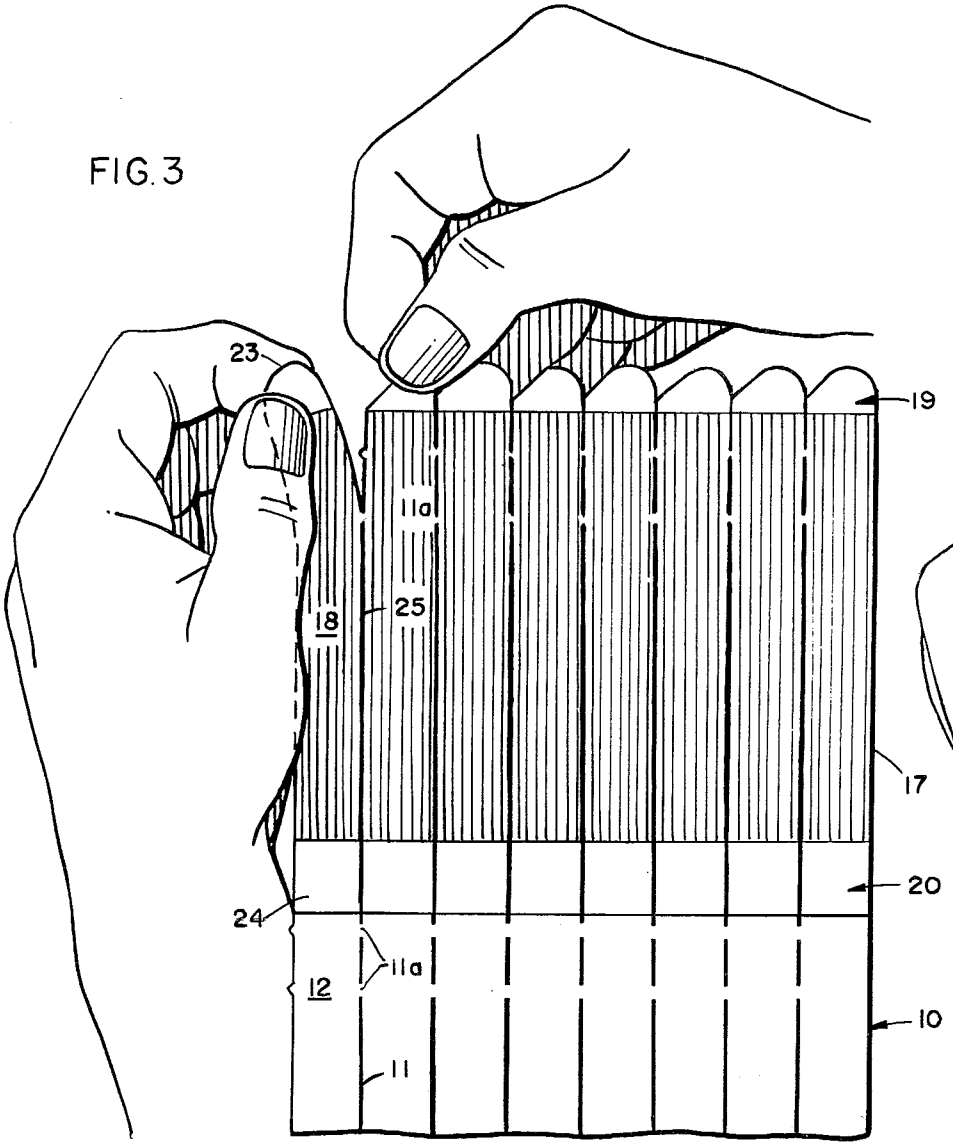
FIG. 3 is a perspective view illustrating the removal of a single identification strip from the assembly of FIG. 1.
Figure 5:
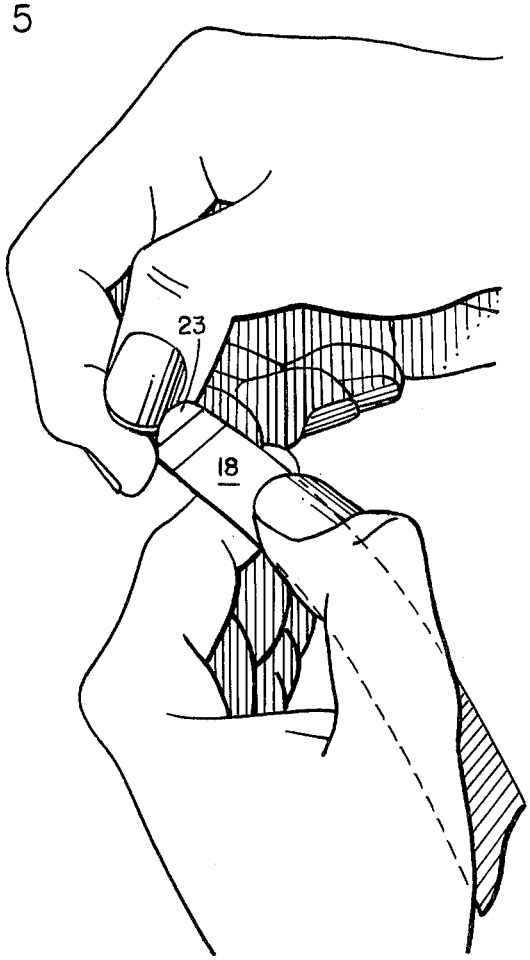
FIG. 5 is a perspective view illustrating another procedure for removing the carbon strip after imprinting the base strip.

The operation of the assembly prepared in accordance with the present invention is illustrated in FIGS. 3 to 5. The first step, as shown in FIG. 3, will usually be the separation of an individual base strip 12 with attached carbon strip 18. Conveniently, as shown, the tab ends 23 of adjacent strips may be grasped with the fingers, and the end strip removed by breaking the ties 11*a* with a tearing motion. Because of the adhesive attachment in the areas 21, 22 at each end of the carbon strip 18, the strip will remain securely attached to the base strip 12.

After the separation of the individual strip, it is inserted in a roller-type imprinter. The imprinter may be equipped with an ink applying roller, which can be drawn across the strip being imprinted from either end. The embossed card bearing the patient indentification information is inserted in the machine with the embossed portion upwardly, and the strip is placed on top of it with the carbon strip 18 uppermost. The ink roller is then drawn across the strip. The roller may contact the strip first from either the insertion end 16, or the handle end 15, since the carbon strip 18 is held in position at both ends by the adhesive attachment. As the roller is drawn over the coated portion 17*a* of the carbon, the embossing of the patient card will cause the carbon to print the desired information on the top of the identification section 14. As many lines as needed may be provided, but, conveniently, the base strips may be provided in 2, 3, or 4 line widths. This permits the printing of 2, 3 or 4 lines of patient identification information, as desired with respect to the particular hospital identification system.

After the completion of the imprinting, the carbon strip 18 is readily removed. One removal procedure is illustrated in FIG. 4. The tab 24 during the imprinting has been in flat planar relation with the base strip, and therefore may be difficult to grasp with the fingers. However, the imprinted strip can be flexed, as indicated in FIG. 4, causing the tab 24 to separate from the underlying portion of the base strip. The tab can then be readily grasped and drawn toward the insertion end of the strip to release the adhesive attachment, first at the area 22, and then at the area 21.

Where desired, the carbon strip 18 can be removed from the insertion end. In one procedure, as illustrated in FIG. 5, the insertion end portion of the strip may be flexed and the thumbnail inserted under the outer edge of tab 23 to lift it for ease of grasping. The tab 23 may then be pulled toward the handle section in the direction illustrated in FIG. 6 breaking the adhesive attachment at 21 first and then at 22. In FIG. 6, there can also be seen the information applied to the top of the identification section 14, being printed from the carbon coating 17*a*. Where the roller used for the imprinting is an ink roller, the ink applied to the surface of the carbon strip 18 does not cause any problem. It is simply removed with the carbon strip and discarded.

After removal of the carbon strip, the identification section 14 is inserted in the hospital bracelet according to the usual procedure. The handle section 15 can be used to guide the insertion, and after the insertion has been made, it can be readily separated along the division line 13. Such an insertion procedure itself is known and does not per se form part of the present invention. However, it should be noted that the carbon strips 18 as applied to the base strips do not interfere with the insertion procedure. The carbon strip may be completely removed prior to the insertion, or it can be detached from the insertion end and folded back onto the handle section during the insertion. Further, even if the printed information is contacted with the fingers, or otherwise subject to smudging prior or during insertion, the use of a carbon paper coated with a non-smearing type of ink assures that the patient identification will remain readable. One suitable carbon paper for this purpose, is carbon paper No. 5204, of Frye Copy Systems, Inc., Cincinnati, Ohio. Other equivalent carbon papers are commercially available.

By providing the carbon strips 18 with two removal tabs, such as the tabs 23 and 24, the assemblies are better adapted for use by both right-handed and left-handed people. This will increase the convenience of use of the assemblies. Further, in the event that it is difficult for a user to grasp one of the tabs, or if one of the tabs should become torn and incapable of performing its removal function, the other tab can be used. The tabs therefor are not merely duplicates of each other, but provide greater protection and convenience.

Assemblies constructed in accordance with the present invention can easily be manufactured on automatic machinery. The paper stock for the base sheet will usually be supplied in rolls as will the carbon paper for the overlay sheets. In one suitable manufacturing procedure, the paper stock is first printed with instructions for use, and also with indicia to assist the user in locating the division line between the identification and handle sections. The instructions for use can be applied to the handle sections, leaving the identification section ready to receive the patient information.

Following the printing operation, the paper stock may be preforated with suitable dies to form the lines of perforations between the identification and handle sections. Bands of adhesive may then be applied to the portions of the base sheet which will underlie the marginal portions of the carbon sheet. A suitable location for the bands of adhesive, 21, 22 is shown in FIG. 1.

The carbon sheet is then applied from the carbon roll stock to form the laminate of the base sheet and the carbon sheet. The laminate is then die cut to form the individual strips, the carbon paper and the base sheet being cut simultaneously to form the rows of perforations and connecting ties between the strips, and also the rounded insertion ends of the strips. This die cutting may be in accordance with the lay-out of FIG. 1.

As will be appreciated, all of the foregoing manufacturing operations can be formed rapidly and accurately with the available manufacturing equipment. Thus, the assembly of the present invention is very well adapted for large scale commercial production.

I claim:

1. An assembly for preparing imprinted inserts for hospital identification bracelets, including a base sheet of imprintable card stock, said sheet being divided by rows of parallel perforations into a plurality of severable elongated strips, said strips being divided by a transverse line of perforations across the central portion thereof into an identification section and a severable handle section, said identification sections having an outer insertion end portion of tapering shape, wherein the improvement comprises: a sheet of carbon paper arranged to overlay said identification sections with the carboncoated side thereagainst, said carbon sheet being divided into a plurality of severable elongated strips having severance lines in alignment with those of said base sheet so that the base sheet strips can be removed one at a time with the respective overlying carbon strip, said carbon sheet strips each having a first uncoated margin extending over the insertion end portion of the underlying base strip and a second uncoated margin on the opposite side thereof adjacent the line of division between said identification and handle sections, said first and second margins of each carbon strip being adhesively attached to said base sheet in defined areas spaced inwardly from the outer edge of their respective margin, both of said margins providing unattached tab portions extending outwardly from said adhesive areas, one of said tab portions of each carbon strip overlying an insertion end of the underlying base strip and the other tab portion overlying the handle section thereof, said carbon strips being removable after the imprinting of said base strips by grasping one of said tab portions at either end thereof.

* * * * *